United States Patent [19]
McVey
[11] 4,292,617
[45] Sep. 29, 1981

[54] THERMAL SWITCH WITH ELECTRICALLY CONDUCTIVE THERMAL SENSING PELLET

[75] Inventor: John K. McVey, Bensenville, Ill.

[73] Assignee: Illinois Tool Works Inc., Chicago, Ill.

[21] Appl. No.: 134,712

[22] Filed: Mar. 27, 1980

[51] Int. Cl.[3] ..... H01H 37/76
[52] U.S. Cl. ..... 337/407; 337/408
[58] Field of Search ..... 337/407, 408, 409, 401–406, 337/410–414

[56] References Cited

U.S. PATENT DOCUMENTS 4,085,397 4/1978 Yagher ..... 337/407
4,167,724 9/1979 McCaughna ..... 337/407

*Primary Examiner*—Harold Broome
*Attorney, Agent, or Firm*—Glenn W. Bowen; Thomas W. Buckman

[57] ABSTRACT

A thermal switch is described which has a pair of axial leads, one of which is electrically insulated from the conductive outer housing and the other of which is in contact with the housing. An electrically-conductive temperature-sensing pellet which is made of solder, or other conductive material, is formed into a donut shape and rests on the bottom of the housing. A donut shaped insulator rests on top of the sensing pellet to protect the pellet from excessive force on it. A ring-shaped sliding contact is placed on top of a ceramic insulator and is bowed outwardly between the ceramic insulator and a conductive disc, which is in contact with the head of the insulated lead, so as to contact the conductive outer wall of the housing. When the temperature-sensing pellet melts, the solder flows allowing the contact to relax to its undeformed state and a spring that surrounds the insulated lead then forces the contact away from the head of the insulated lead. The solder repellent grease preferably surrounds the insulated lead so as to minimize the possibility of melted solder contacting this lead.

10 Claims, 3 Drawing Figures

Fig. 1
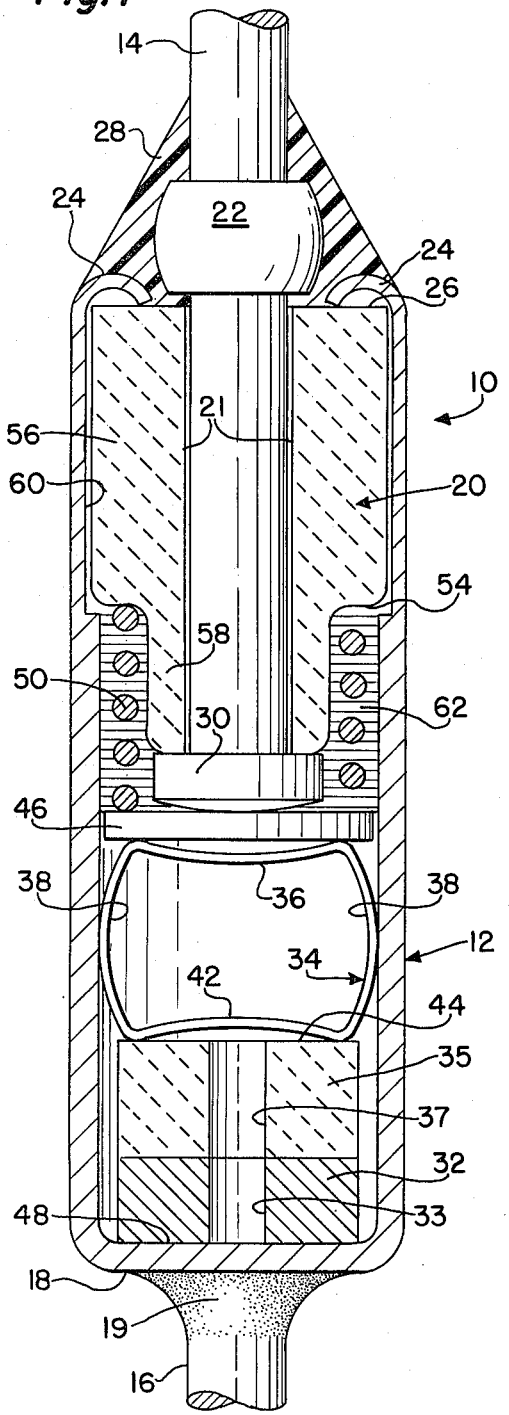
Fig. 2
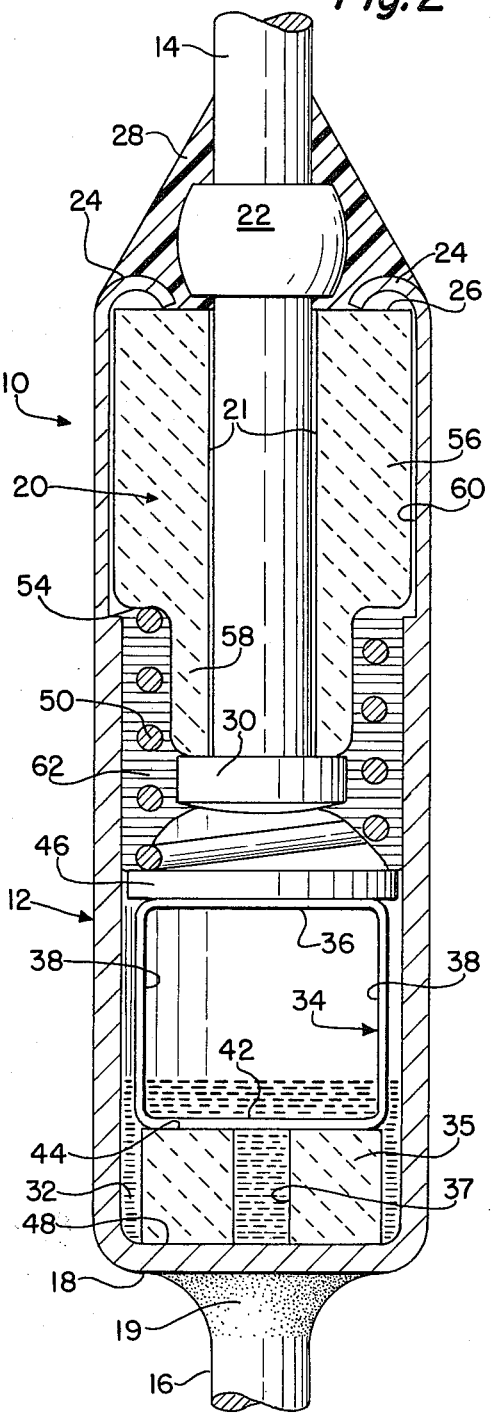
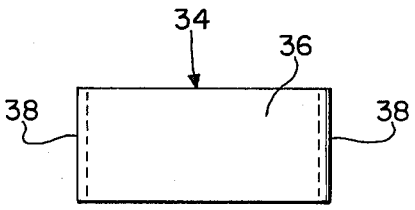
Fig. 3

THERMAL SWITCH WITH ELECTRICALLY CONDUCTIVE THERMAL SENSING PELLET

BACKGROUND OF THE INVENTION

Although there are a number of different types of thermal cut-off switches, many of them are overly complex and utilize more parts than are commercially feasible for many applications. The construction of a simple, inexpensive, but effective thermal cut-off device using a minimum number of parts, therefore, continues to be a challenge. One attempt at providing a simplified thermal cut-off switch design utilizing a minimum number of parts is shown in Japanese Utility Model Laid-Open Publication No. 15922/72, which was filed under the name of Murata Manufacturing Company Limited. In this type of device, a hollow structure having a normally elongated oblong shape with a continuous circumference is connected directly to the insulated lead.

When the pellet is inserted into the device and the oblong contact is forced against the pellet, it is bowed outwardly until it contacts the outer metallic housing of the device. The Murata device, however, can be difficult to manufacture due to the small size of the parts and because of the necessity of either providing either a hole in the contact through which the head of the insulated lead may pass, or of some other means of permanently securing the hollow contact to the head of the insulated lead which will not be affected by high temperatures. The contact of the Murata device engages the thermal pellet at essentially a single point, thereby subjecting the pellet to a high stress which tends to destroy the integrity of the pellet of organic chemical material and to reduce the reliability of the device because of premature opening of the switch.

Another design which utilizes a bowed hollow contact member with a continuous circumference or perimeter is shown in U.S. Pat. No. 4,167,724, issued Sept. 11, 1979, in the name of James R. McCaughna. The McCaughna device differs from the Japanese Murata device in that the hollow contact structure of this switch has a general rectangular shape and it is not permanently secured to the head of the insulated lead. Instead, the insulator through which the insulated lead passes has a reduced diameter portion which is encircled by a coiled spring which tends to force the contact member toward the thermally-sensitive pellet. The McCaughna thermal cut-off switch, has a flat contact area which engages the thermal pellet; and thus, there is a good force distribution on the thermal pellet in the McCaughna switch.

The present invention is described by reference to a thermal switch in which a McCaughna-type of electrical contact is employed. However, the McCaughna device contemplated the use of non-conductive thermal sensing pellets made of organic chemical material. Such pellets are ideal for certain temperature ranges. The organic chemical material does impose temperature range limitation upon the switch, however, and these materials are relatively expensive. In order to provide a switch with a reduced cost and an extended temperature range, the switch of the present invention employs a pellet of electrically-conductive solder material, the composition of which depends upon the temperature range desired. For example, conventional tin-lead solder mixtures of silver-solder mixtures may be employed. The design features of the present invention are directed to making the use of such materials possible in thermal sensing switches.

DESCRIPTION OF THE DRAWINGS

The present invention is described by reference to the drawings in which:

FIG. 1 is a cross-sectional view of a thermal switch of the present invention in a closed-switch state; and FIG. 2 is a cross-sectional view of the thermal switch in an opened-switch state.

FIG. 3 is a side view of the closed-ring contact 34.

TECHNICAL DESCRIPTION OF THE INVENTION

The thermal switch 10 of the present invention has a pair of axial leads 14 and 16. The lead 16 is connected to the metallic conductive outer housing 12 of the device at the bottom wall 18 by means of the welded joint 19. The other lead 14 passes through an insulator 20 which has a central opening 21 which allows the lead to pass through it from the bottom upwardly as shown in FIG. 1. After the lead has passed through the insulator, a ring 22 is crimped onto it to prevent it from being forced inwardly by inward pressure on it. The upper open portion of the housing 12 is then bent over along the rim 24 over the top 26 of the insulator 20, and an epoxy material 28 is provided over the bent-over rim 24 and the crimped ring 22 to secure and seal off the open end of the device. An enlarged head 30 is formed on the lead 14 adjacent the bottom of the insulator 20.

A temperature-sensing pellet 32, which melts at a predetermined temperature and which is preferably made of a solder material, rests on the bottom surface 48 of the metallic housing 12. The pellet 32 is preferably shaped as a cylindrical wafer with a central hole 33 in it. An electrically insulating cylindrical load bearing wafer 35 of substantially the same dimensions preferably made of a ceramic material and also having a central hole 37 in it is positioned on top of the pellet 32 so that there is a gap between the top surface 44 of the wafer 35 and the head 30 of the lead 14. The pellet 32 is preferably made with conventional solder materials including tin-lead and silver-solder mixtures, and other conventional meltable conductive mixtures.

An electrically conductive contact, which is formed as a flexible, thin, closed-ring contact 34, is placed in this gap between the wafer 35 and the head 30. The contact 34 has a bottom surface 42 which may be slightly bowed and which rests on the top surface 44 of the wafer 35. The sides 38 of the contact 34 are outwardly bowed in the gap so as to contact the inner wall of the conductive housing 12. The upper surface 36 of the contact 34 may also be bowed and contacts the flat, electrically conductive disc wafer 46 between the head 30 and the surface 36.

In operation, the thermal switch will be in its closed state when the conductive solder pellet 32 is solid, as shown in FIG. 1. A coiled operating spring 50 encircles the reduced diameter section 58 which necks down from the larger diameter section 56 of the insulator 20. A solder repellent material 62, such as silicone in a grease form, preferably surrounds the insulated head so as to minimize the possibility of melted solder contacting this lead. The wall of the housing is thinner at the top section 60 so as to receive and retain the larger diameter section 56 of the insulator 20 therein. The coiled spring 50 is then compressed and positioned around the narrow diameter portion 58 so that it abuts against the surface 54 on its top end and against the wafer 46 on its bottom end. Thus, when the thermal pellet 32 melts, it will flow through the hole 37 and around the contact 34, shown in FIG. 2. Consequently, when this occurs, the spring 50 will force the wafer 46 and the contact 34 downwardly towards the bottom surface 48 of the housing 12, thus relieving the initial bowed deformation of the contact 34. The contact 34 then assumes its relaxed, undeformed state, as shown in FIG. 2, and contact between the housing and the head 30 is thereby interrupted.

Although it is anticipated that any type of solder may be used, the following compositions are representative of suitable compositions. In addition, pure metals such as tin and lead may also be used to obtain a temperature melting range from about 95° C. to 327° C., for pure lead.

| Composition | Temperature |
|---|---|
| 50% Sn + 32% Pb + 18% Cd | 146° C. |
| 15.5% Sn + 32% Pb + 52.5% Bi | 95° C. |
| 1% Sn + 97.5% Pb + 1.5% Ag | 309° C. |
| 96.5% Sn + 0% Pb + 3.5% Ag | 221° C. |
| 62.5% Sn + 36.1% Pb + 1.4% Ag | 179° C. |
| 63% Sn + 37% Pb | 183° C. |

The silicone grease may comprise Dow Corning 340 Heat-Sink Compound.

What is claimed is:

1. A thermal switch comprising an elongated conductive housing having first and second ends, a first axial lead electrically connected to said conductive housing at said first end, an insulator positioned in said conductive housing at said second end, a second lead that passes through said insulator into the interior of said housing, a thermally sensitive pellet comprising a metallic composition and having a generally flat top surface inserted into said housing at said first end and positioned so as to leave a gap between said insulated lead and said first end, a thin conductive disc positioned in contact with said insulated lead, a compressed coiled spring that encircles at least a portion of said insulator so as to provide a spring bias force on said disc toward said sensing pellet and a ring-shaped electrically conductive contact member having a continuous periphery and a generally flat base surface which lies substantially parallel to said top surface of said thermal sensing pellet, side contact surfaces which contact the inside of said conductive housing when said contact member is inserted into said gap and a generally flat top surface which lies substantially parallel to said conductive disc, a load bearing wafer which has a substantially flat top and bottom surfaces positioned between the base surface of said contact member and the top surface of said thermal sensing pellet and a liquid metal-repellent grease confined around said coiled spring by said conductive disc and said insulator.

2. A thermal switch as claimed in claim 1 wherein said thermal sensing pellet is comprised of a substantially pure metal.

3. A thermal switch as claimed in claim 2 wherein said metal is selected from the class consisting of tin and lead.

4. A thermal switch as claimed in claim 1 wherein said metal is a solder composition.

5. A thermal switch as claimed in claim 4 wherein said metal is selected from the class consisting of solders containing tin and lead.

6. A thermal switch as claimed in claim 1 wherein said load bearing member is an electrically-insulating member formed of ceramic material.

7. A thermal switch as claimed in claim 1 wherein said thermally sensitive pellet is formed in the shape of a short segment of a circular cylinder element which has a central hole running through it.

8. A thermal switch as claimed in claim 7 wherein said load bearing wafer is constructed in the shape of a segment of circular cylindrical element having a central hole running through it.

9. A thermal switch as claimed in claim 8 wherein said thermally sensitive pellet is formed in the shape of a short segment of a circular cylindrical element which has a central hole running through it.

10. A thermal switch as claimed in claim 1 wherein said liquid metal-repellent grease is a silicone grease.

* * * * *